US005181712A

United States Patent [19]

Perino

[11] Patent Number: 5,181,712

[45] Date of Patent: Jan. 26, 1993

[54] SHEET FEEDING DEVICE HAVING THE ABILITY TO BACK A SHEET INTO THE SHEET SUPPLY TRAY

[75] Inventor: Andrea Perino, Cuorgne', Italy

[73] Assignee: Olivetti-Canon Industriale S.p.A., Ivrea, Italy

[21] Appl. No.: 798,101

[22] Filed: Nov. 26, 1991

[30] Foreign Application Priority Data

Dec. 10, 1990 [IT] Italy ..... 67987 A/90

[51] Int. Cl.[5] ..... B65H 3/06; B65H 3/52

[52] U.S. Cl. ..... 271/109; 271/124; 271/127; 271/157

[58] Field of Search ..... 271/109, 115, 117, 121, 271/122, 157, 124, 125-127

[56] References Cited

U.S. PATENT DOCUMENTS

| | | | |
|---|---|---|---|
| 4,316,606 | 2/1982 | Buys et al. | 271/125 |
| 4,422,631 | 12/1983 | Sugizaki | 271/164 |
| 4,526,358 | 7/1985 | Ura et al. | 271/125 |
| 4,529,189 | 7/1985 | Konishi et al. | 271/117 |
| 4,667,947 | 5/1987 | Costa et al. | 271/121 |
| 4,798,374 | 1/1989 | Ito | 271/157 |
| 5,029,838 | 7/1991 | Kunihiro | 271/157 |

FOREIGN PATENT DOCUMENTS

| | | | |
|---|---|---|---|
| 152727 | 9/1983 | Japan | 271/157 |
| 57842 | 4/1984 | Japan | 271/109 |
| 16948 | 1/1987 | Japan | 271/157 |
| 41335 | 2/1988 | Japan | 271/125 |
| 300037 | 12/1988 | Japan | 271/125 |
| 1-192639 | 8/1989 | Japan | 271/157 |

*Primary Examiner*—Robert P. Olszewski
*Assistant Examiner*—Steven M. Reiss
*Attorney, Agent, or Firm*—Banner, Birch, McKie & Beckett

[57] ABSTRACT

The device for the introduction of sheets makes it possible to introduce a stack of sheets through an auxiliary input or by-pass in addition to or as an alternative to the normal cassettes for sheets, with which the machine is fitted. A roll (57) rotating on a shaft (58) separates sheets from a stack inserted into a tray (54). A lever (68) is movable from a rest position to a function position. When the lever is moved to the functional position it causes a unidirectional clutch (86) mounted on the shaft to reverse the direction of rotation of the roll thereby moving sheets back to the tray. The lever also moves a cam (76) such that when the lever moved to the functional position, the tray is moved away from the roll such that additional sheets can be inserted.

7 Claims, 3 Drawing Sheets

SHEET FEEDING DEVICE HAVING THE ABILITY TO BACK A SHEET INTO THE SHEET SUPPLY TRAY

BACKGROUND OF THE INVENTION

The present invention relates to a device for the introduction of sheets into a machine for the reproduction or printing of documents, or into similar office machines.

The device for the introduction of sheets according to the invention may be used either in a machine for the reproduction of documents, such as a photocopier, or on a typewriter of printer fitted with an automatic sheet feeder.

The description which follows refers by way of non-limiting example to the use of the device for the introduction of sheets into a copier.

Known conventional copiers usually have a fitted paper cassette or cassettes and also an auxiliary input for sheets having a different format from that of the fitted cassettes, or for sheets which already have other material printed on them, and these have, to be inserted manually by the operator. However, known copiers only enable sheets to be introduced through this input one at a time, thus a great deal of time will be required to make a succession of copies on sheets introduced manually into the aforementioned auxiliary input.

SUMMARY OF THE INVENTION

A preferred embodiment of the present invention provides a device for the introduction of sheets into a machine for the reproduction or printing of documents. This device allows a stack of sheets to be introduced through an auxiliary input, in addition to, or as an alternative to the normal cassettes of sheets with which the machine is fitted. Preferably the device makes it possible to add sheets to others already in a stack at the auxiliary input before the other sheets are exhausted.

In a preferred embodiment the introduction device comprises a tray into which the sheets are placed. A roll mounted on a shaft rotates to separate the sheets from the tray and to introduce them into the machine and a block cooperates with the roll to hold back any possible second sheets. Movement of a lever from a rest position to a functional position causes a unidirectional clutch mounted on the shaft to be engaged. This reverses the direction of rotation of the roll thereby, moving back any sheets held between the roll and the block.

A cam can be provided on the lever to move the tray away from the roll as the lever is moved to its functional position. This facilitates the insertion of further sheets into the tray.

The invention is defined in its various aspects in the appended claims to which reference should now be made.

DETAILED DESCRIPTION OF PREFERRED EMBODIMENTS

This and other features of the invention will emerge more clearly from the following description of an embodiment, given by way of non-limiting example with reference to the accompanying drawings, in which.

Figure 1:
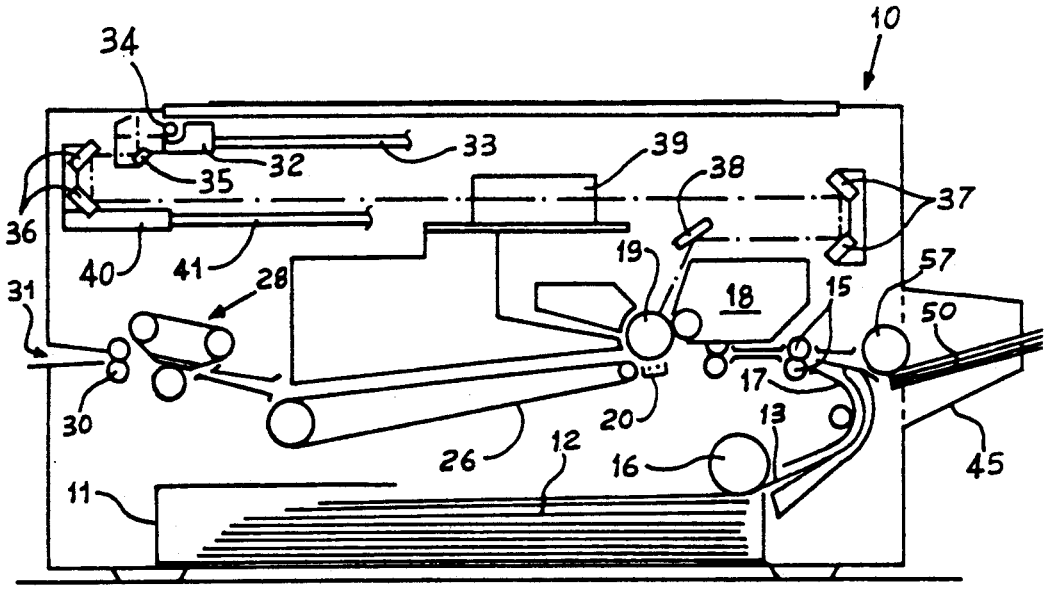
FIG. 1 shows an illustrative application of the device according to the invention to a copier.

With reference to FIG. 1, a copier 10 comprises a cassette 11 containing a stack 12 of sheets of paper 13. The sheets are separated and forwarded one at a time by a sheet separator roll 16 and passed through a channel 17 and by means of register rolls 15 to a developer unit 18 comprising a photoconducting drum 19 and a transfer unit 20. In the transfer unit 20, an image of an original 22, developed in the unit 18 by a toner, is tranferred to the sheet 13. The sheet 13 is next transported by a moving belt 26 to a fixing station 28 in which the toner image is fixed stably to the sheet 32.

The image of the original 22 is reflected onto the drum 19 by means of an optical system of the type known in the art and represented diagrammatically in the top part of FIG. 1.

The optical system comprises a carriage 32 which runs along guides 33 in order to scan the original 22. A light source 34 mounted on the carriage 32 illuminates the original 22 and its image is reflected by a series of mirrors 35, 36, 37 and 38 and focused on the drum 19 by an objective 39.

The mirror 35 is mounted on the carriage 32, while the mirrors 36 are mounted on an auxiliary carriage 40 which runs along guides 41 at half the speed of the carriage 32; the mirrors 37 and 38, however, are stationary.

The device for introducing sheets according to the invention, indicated diagrammatically by 45 in FIG. 1, is applied to the copier 10 as a non-limiting example, but may also be applied to any other office machine fitted with an automatic sheet feeder.

The device 45 according to the invention makes it possible to introduce into the copier 10 sheets of a different format than those contained in the cassette 11, in sufficient quantity, for example approximately 50 sheets, for so-called continuous copying runs. Also, sheets may be added to the device 45 before those already present are exhausted, without affecting the normal and correct introduction of sheets towards the developer unit 18.

Figure 2:
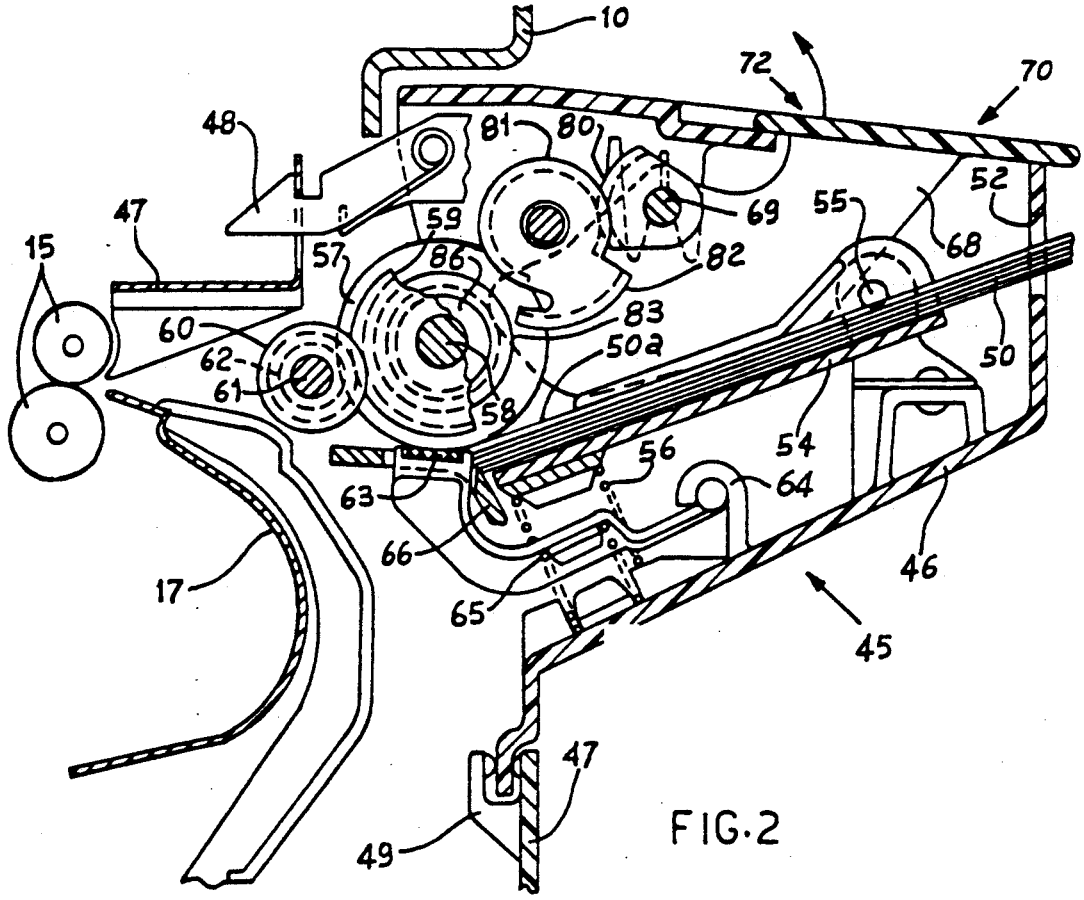
FIG. 2 shows a side elevation of the device for the introduction of sheets according to the invention.

With reference to FIG. 2, the device 45 for the introduction of sheets comprises its own support frame 46 and is connected to the frame 47 of the copier 10 by means of a hook 48 and a support 49. A stack of sheets 50, containing up to approximately 50 sheets, is introduced into the device 45 through an opening 52 in the support 46 and is rested on a pivoting tray 54 hinged laterally on a pin 55 fixed to the support 46. The tray 54 is pushed upwards by a spring 56, so bringing the top sheet **50*a* of the stack 50 up against a sheet separator roll 57** rotating clockwise.

The roll 57 is mounted on a shaft 58 (FIG. 3) rotating on the support 46 and connected via gears 59 and 60 to a drive shaft 61 internal to the copier 10. Between the shaft 61 and the gear 60 is an electromagnetic clutch 62 activated by a control circuit in the copier, not shown in the drawings. The clutch 62 is activated in order to transmit the motion between the shaft 61 and the roll 57 only during the period in which a sheet **50*a* (FIG. 2) is being separated from the stack 50**. Normally the clutch 62 is deactivated, and the gear 60 is then free to turn idly on the shaft 61.

A block 63, hinged on a bearing 64 of the support 46, is pressed by a spring 65 against the roll 57 to block the path of a second sheet that may be accidentally stuck to the top sheet 50*a*.

The sheet stack 50 is introduced along the tray 54 until it rests frontally against a fixed check piece 66. To facilitate the insertion of the sheet stack 50 along the tray 54 and to ensure correct positioning of the sheets underneath the roll 57, the tray 54 is lowered (FIG. 4) by means of a lever 68 provided with a cam 76 acting against the plane 78 of the tray 54.

The lever 68 is rotatable about a pin 69 by means of a knob 70, from a rest position 72 (FIG. 2) to an operating position 74 (FIG. 4) in which the cam 76 lowers the tray 54 away from the roll 57, with an anticlockwise rotation of approximately 90°.

When a large number of copies are to be made, for example up to 50 in the format of the sheets already present on the tray 54, and the number of sheets present on the tray 54 is insufficient, extra sheets may be added on top of those already in the tray 54.

Since after every sheet-separating operation one or more sheets 50*a* (FIG. 2) remain caught between the roll 57 and the block 63, it is necessary, before inserting extra sheets along the tray 54, to free the caught sheets and arrange them with their front edge up against the check 66.

To this end, the lever 68 is connected kinematically to the sheet separator roll 57 to rotate it anticlockwise, so as to push back sheets caught between the roll 57 and the block 63.

A toothed arc 80 is integral with the lever 68 and engages with an idle gear 81. The gear 81 comprises a toothed arc 82 extending over an angle of approximately 90°. This is able to engage with a toothed wheel 83 mounted idly on the shaft 85 of the roll 57. The toothed wheel 83 is connected with the roll 57 through a unidirectional clutch 86, so as to transmit the rotation to the roll 57 in the anticlockwise direction only.

Figure 4:
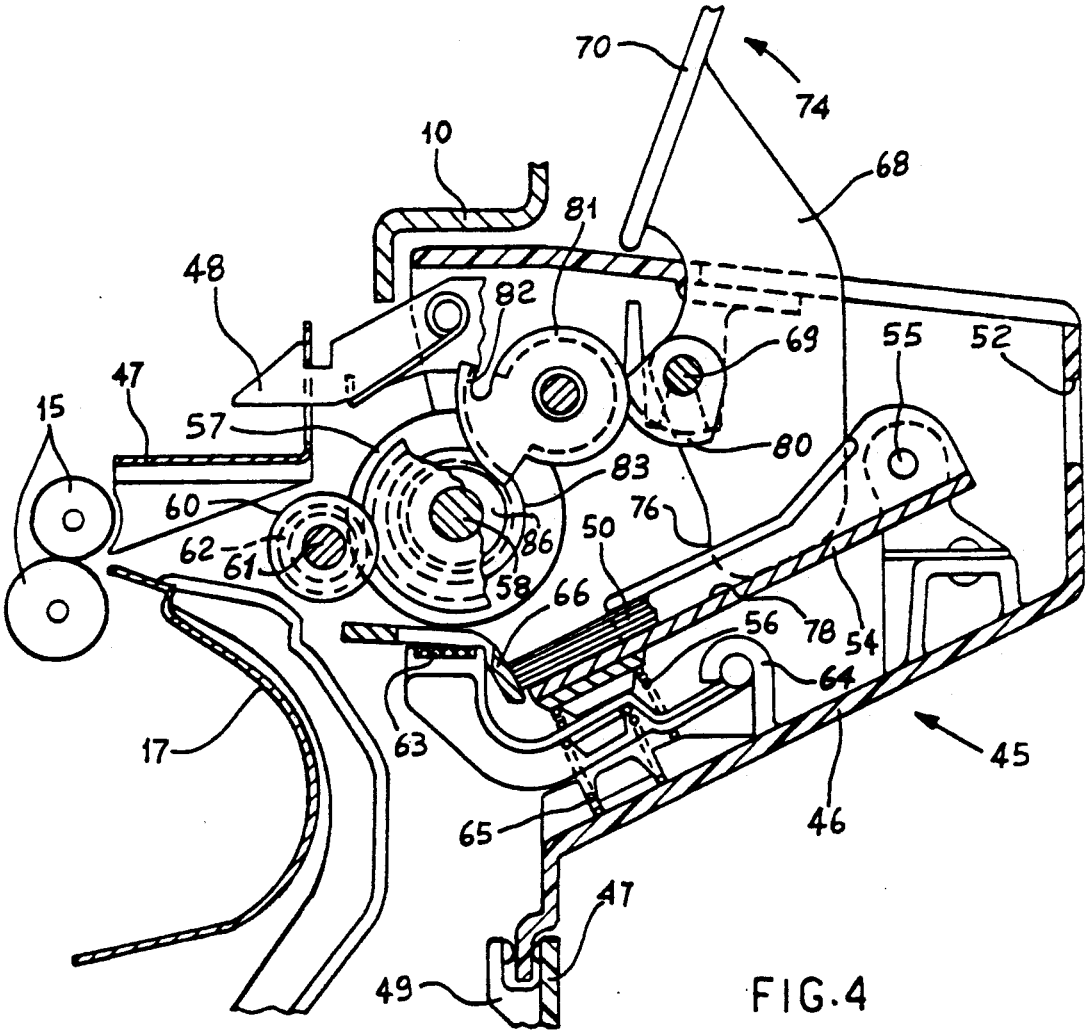
FIG. 4 shows the device of FIG. 2 as prepared for the insertion of sheets.

Accordingly, before inserting sheets into the tray 54 in addition to others already present, the lever 68 is raised to the position 74, indicated in FIG. 4.

The toothed arc 80, acting through the wheel 81, the arc 82 and the gear 83, turns the roll 57 anticlockwise, since the clutch 86 is engaged, with the result that sheets caught between the roll 57 and the block 63 are moved back past the check 66. At the same time the tray 54 is rotated downwards by the cam 76.

At this point, the tray 54 can be resupplied with extra sheets, these being placed on top of those already present and up against the check 66.

After rotating the lever 68 into the rest position 72 (FIG. 2), the sheet-separating operation may be resumed in the regular way.

Lastly, towards the end of travel of the tray 54 (FIG. 4), the block 63 is withdrawn from the roll 57 to allow any sheets trapped in the event of malfunctioning of the sheet separator to be removed.

Figure 3:
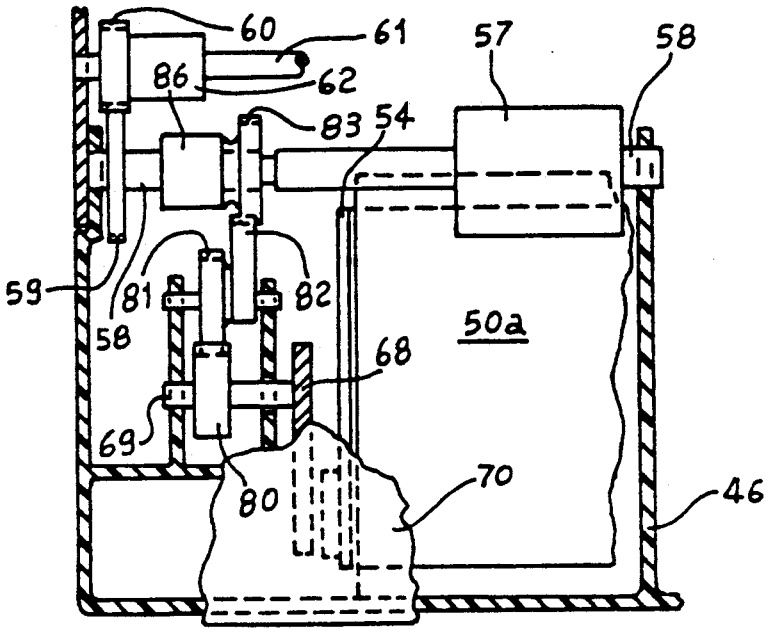
FIG. 3 shows a partial plan view of the device of FIG. 2.

It should be noted that when the lever 68 is in the rest position 72 (FIG. 2), the toothed arc 82 is disengaged from the gear 83 and that therefore the sheet separator roll 57 can turn freely, driven by the drive shaft 61 (FIG. 3).

Figure 5:
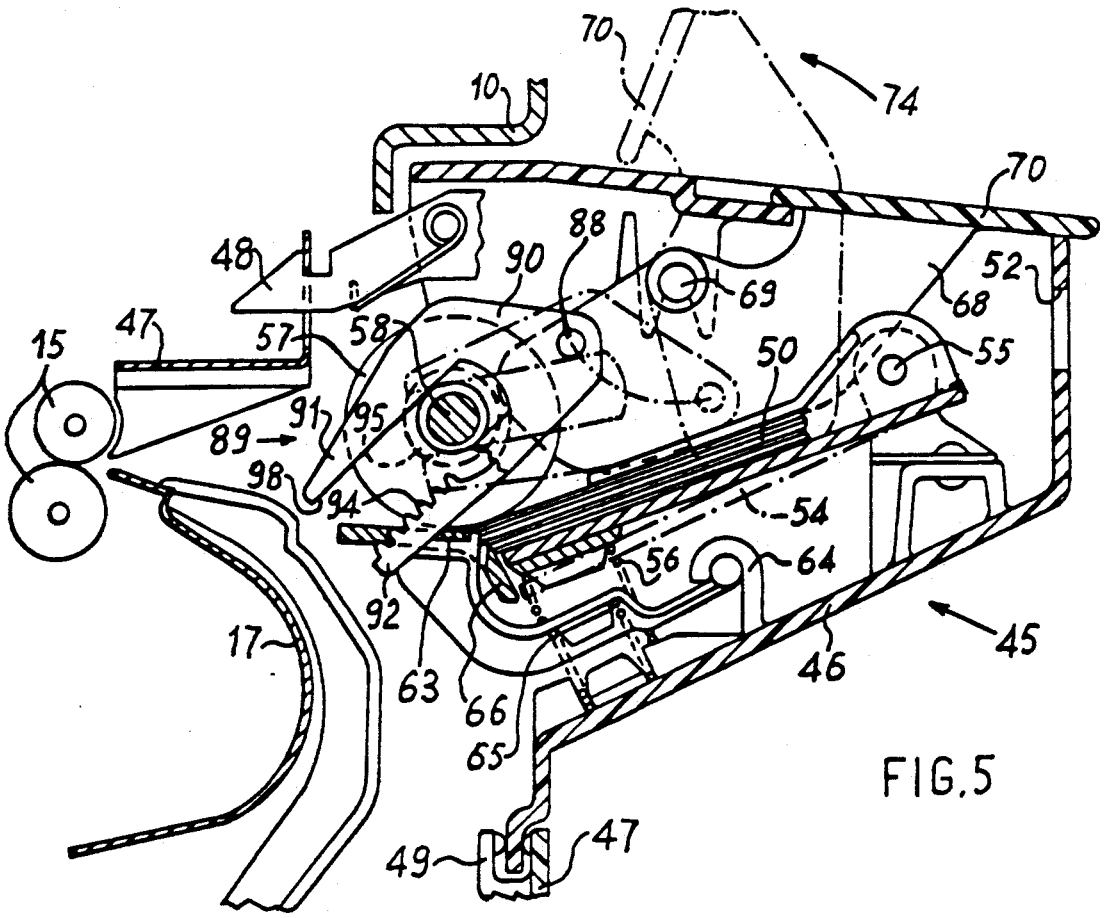
FIG. 5 shows a variant of the device of FIG. 2

FIG. 5 shows a different embodiment of the kinematic connection between the lever 68 and the roll 57.

Hinged to the lever 68 on a pin 88 is a link block 90 having a fork 89 with two arms 90 and 92.

Figure 6:
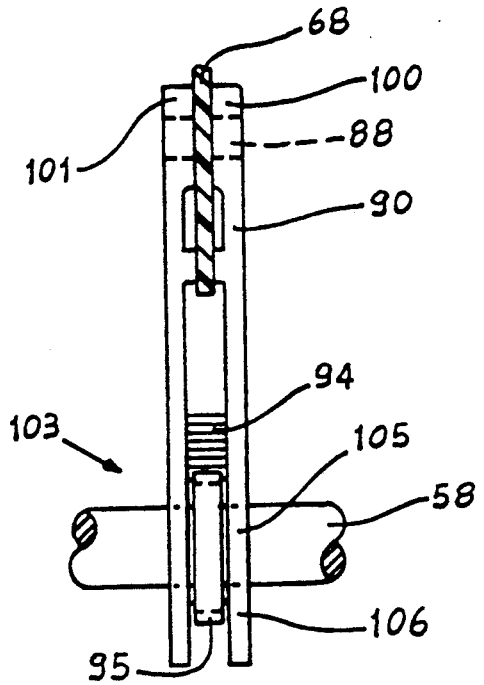
FIG. 6 shows the constructional details of a link block of FIG. 5.

The lower arm 92 is equipped with a rack 94 for engaging with the toothed wheel 95 mounted on the shaft 58 of the sheet separator roll 57 and connected to this last by means of a unidirectional clutch 97, identical to the clutch 86 (FIG. 4). The upper arm 90 (FIG. 5) is delimited by a flat surface 98 parallel to the axis of the rack 94 and embraces the shaft 58 so as to guide the fork 89 and oppose the radial thrust of the rack 94. FIG. 6 shows the constructional details of a preferred, but non-limiting, embodiment of the link block 90.

The link block 90 is formed by two identical, flat parallel elements 100, 101 separated by a distance slightly greater than the width of the toothed wheel 95.

Each of the two elements 100 and 101 terminates on one side in a fork 103 whose two arms 105, 106 embrace the shaft 58, so as to guide the link block 90 with respect to said shaft.

On the other side, each of the two elements 100, 101 has a hole with which to engage the pin 88 of the lever 68 (FIG. 5).

The rack 94 is interposed between the two arms 105, 106 and is for engaging with the wheel 95. The length L of the rack 94 (FIG. 5) is limited in such a way that when the lever 68 is in the rest position R, the rack does not engage with the wheel 95, and the sheet separator roll 57 is therefore free to rotate in the clockwise direction or in the sheet separating direction, as seen previously.

It will be understood that changes, additions and/or substitutions of parts may be made to the device for the introduction of sheets hereinabove described, without thereby departing from the scope of the invention.

I claim:

1. A device for the introduction of sheets into a machine for the reproduction or printing of documents, comprising:

a tray for holding a stack of sheets;

a shaft rotatable in a first direction;

a driving means operable to rotate said shaft in said first direction;

a feeding roll mounted on said shaft and disposed for contact with a top sheet of said stack to separate the sheets from the tray and to introduce them into said machine;

a block cooperating with said roll to keep back possible second sheets;

a lever movable from a rest position to a functional position; and, a kinematic chain for connecting said lever to said roll in order to rotate the roll in an opposite direction to said first direction, when said lever is rotated to said functional position, so as to move back sheets held between said roll and said block.

2. A device according to claim 1, wherein said kinematic chain comprises:

a driven toothed wheel rotatable idly on said shaft; and, a unidirectional clutch connected to said toothed wheel for rotating said roll in said opposite direction when said lever is moved from said rest position to said functional position.

3. A device according to claim 2, wherein said kinematic chain comprises a toothed arc rotated by said lever to engage said driven toothed wheel when said lever is moved to said functional position.

4. A device according to claim 3, wherein said toothed arc is of a width such that when said lever is in said rest position, said arc does not engage said driven toothed wheel.

5. A device according to claim 2, wherein said kinematic chain comprises:

a link block connected to said lever; and, a rack mounted on said link block for engaging said driven toothed wheel, when said lever is moved to said functional position.

6. A device according to claim 5, wherein said link block comprises two parallel arms a first of which carries said rack and a second of which guides the link block with respect to the shaft.

7. A device for the introduction of sheets into a machine for the reproduction or printing of documents comprising:

a tray for holding a stack of sheets;

a shaft rotatable in a first direction;

a driving means operable to rotate said shaft in said first direction;

a feeding roll mounted on and rotating with said shaft to separate said sheets from said tray and to introduce them into said machine;

a block cooperating with said roll to keep back possible second sheets;

a lever movable from a rest position to a functional position; and a clutch means mounted on said shaft and engaged, in response to movement of said lever from said rest position to said functional position, to rotate said roll in an opposite direction to said first direction.

* * * * *